United States Patent [19]

Anderson

[11] 4,270,113

[45] May 26, 1981

[54] THERMAL OVERLOAD RELAY

[75] Inventor: Paul T. Anderson, Brighton Township, Beaver County, Pa.

[73] Assignee: Westinghouse Electric Corp., Pittsburgh, Pa.

[21] Appl. No.: 28,021

[22] Filed: Apr. 6, 1979

[51] Int. Cl.[3] ..... H01H 71/16

[52] U.S. Cl. ..... 337/75; 337/359

[58] Field of Search ..... 337/75, 359, 72, 70, 337/78, 77

[56] References Cited

U.S. PATENT DOCUMENTS

| | | | |
|---|---|---|---|
| 3,265,831 | 8/1966 | Ramsey et al. | 337/78 |
| 3,792,401 | 2/1974 | Anderson | 337/72 |
| 3,842,383 | 10/1974 | Anderson et al. | 337/151 |
| 4,047,140 | 9/1977 | Anderson et al. | 337/75 |

*Primary Examiner*—Harold Broome
*Attorney, Agent, or Firm*—L. P. Johns

[57] ABSTRACT

A thermal overload relay characterized by a housing containing a plurality of pole units, two pairs of spaced terminals on the housing, one terminal of each pair comprising a stationary contact within the housing, a movable contact mounted on and extending from the other of each terminal and being biased in one of the open and closed positions of the stationary contact, a slide within the housing for moving the movable contact between said positions, latch means on the slide for latching the slide in one of said positions and being spring biased in the other position, reset means for moving the slide to a latched position, each pole unit having a bimetal element responsive to current flow to effect heating thereof, and means associated with the latch means for unlatching the latch means.

6 Claims, 8 Drawing Figures

THERMAL OVERLOAD RELAY

BACKGROUND OF THE INVENTION

1. Field of the Invention

This invention relates to an electric control device and, more particularly, it pertains to a thermally responsive overload relay.

2. Description of the Prior Art

A thermal overload relay is a bimetallic device which provides motor protection for running and stalled rotor overloads. A strip bimetal in the overload relay is electrically heated by heater elements which carry the motor currents. Excess heat is generated in the heater elements by an overloaded motor. The bimetals deflect to thermally open the normally closed contact, thereby opening a coil circuit of a magnetic contactor which disconnects the overloaded motor from the line. Thereafter the relay may be reset by pressing and releasing a reset rod.

Thermal overload relays of the type used to protect an electric motor are known in the art and disclosed in U.S. Pat. Nos. 3,265,831; 3,792,401; 3,842,383; and 4,047,140. Economic factors such as cost of materials in competing products often require a consideration of cost-cutting measures without sacrificing quality. Some prior existing overload relays having reliability and endurance have been too costly and awkward when replacing worn-out or broken parts.

SUMMARY OF THE INVENTION

In accordance with this invention, it has been found that the foregoing problems may be overcome by providing a thermal overload relay having an integral housing comprising a single-molded unit on which the several operating parts are attached, the relay comprising a plurality of pole units, at least one pair of spaced terminals on the housing, one terminal of each pair comprising a stationary contact within the housing, a movable contact mounted on and extending from the other terminal and being biased to one of the open and closed positions of the corresponding stationary contact, a slide within the housing for moving the movable contact between said positions, latch means on the slide for latching the slide in one of said positions and being spring-biased in the other position, manual reset means for moving the slide to a latched position, at least one of the pole units including a bimetal element responsive to current flow to effect heating thereof, and means associated with the latch means for unlatching the latch means.

The advantage of the device of this invention is that it comprises an improved normally closed control circuit, field-mountable normally open control circuit, pust-to-test means, and trip indication in a readily visible position.

DESCRIPTION OF THE PREFERRED EMBODIMENT

Figure 8:
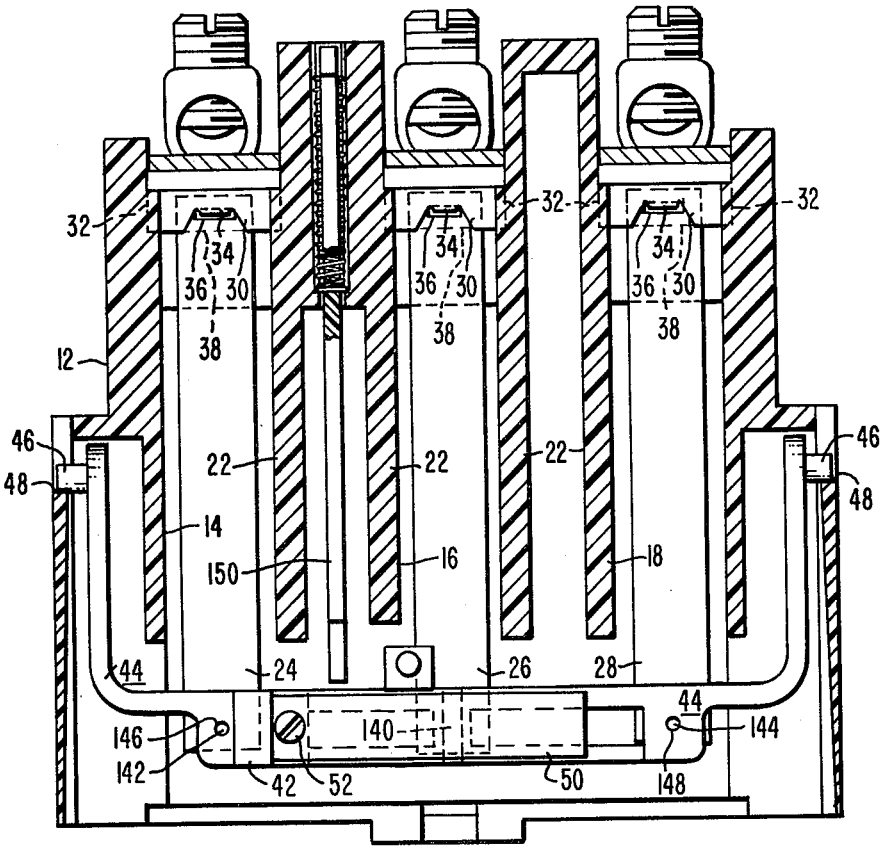
FIG. 8 is a vertical sectional view taken on the line VIII—VIII of FIG. 1.

A thermal overload relay is generally indicated at 10 in the drawings. It comprises a housing 12 which is a single integrated molded unit composed of an electrically insulating material such as a phenolic resin. The molded housing 12 (FIGS. 3, 8) includes a plurality of vertical bores 14, 16, 18, as well as a chamber 20. For insulation, the bores are separated by partitions 22 that are molded integrally with the housing 12. Bimetal elements 24, 26, 28 are disposed in the bores 14, 16, 18, respectively, and are separately suspended at their upper ends by a hanger 30 extending across each bore with opposite end portions 32 secured in suitable notches in the housing. Each hanger 30 includes an out-turned flange 34 (FIG. 3) which extends through an opening 36 in each bimetal element, the upper end portion of which is clamped between the hanger and a surface 38 of the housing so that when heated, the lower end portion 40 moves to the right (FIG. 3), thereby moving a crossbar 42 in the same direction.

The crossbar 42 (FIG. 8) is a U-shaped member having similar up-turned end portions 44 with out-turned trunnions 46 extending into notches 48 of the housing. Thus the crossbar 42 is free to move pivotally on the trunnions. The crossbar 42 is composed of a dielectric material similar to that of the housing 12. The crossbar 42 is also provided with a compensating bimetal 50, which is attached by a screw 52.

Figure 2:
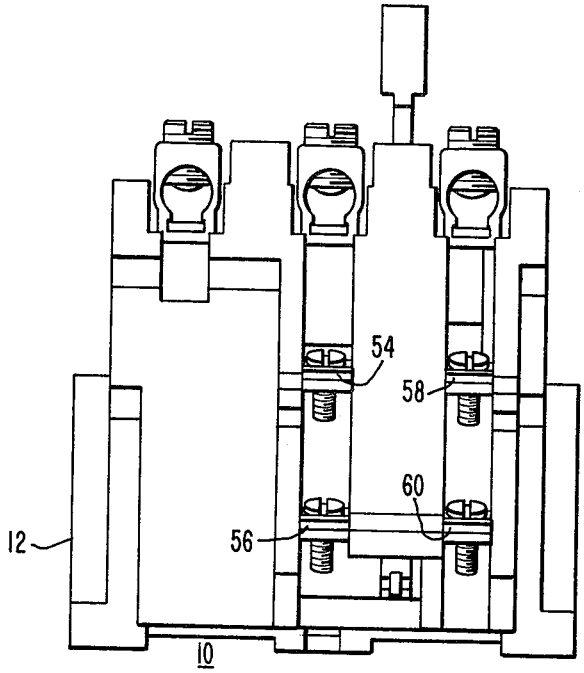
FIG. 2 is a front elevational view of the device.
Figure 3:
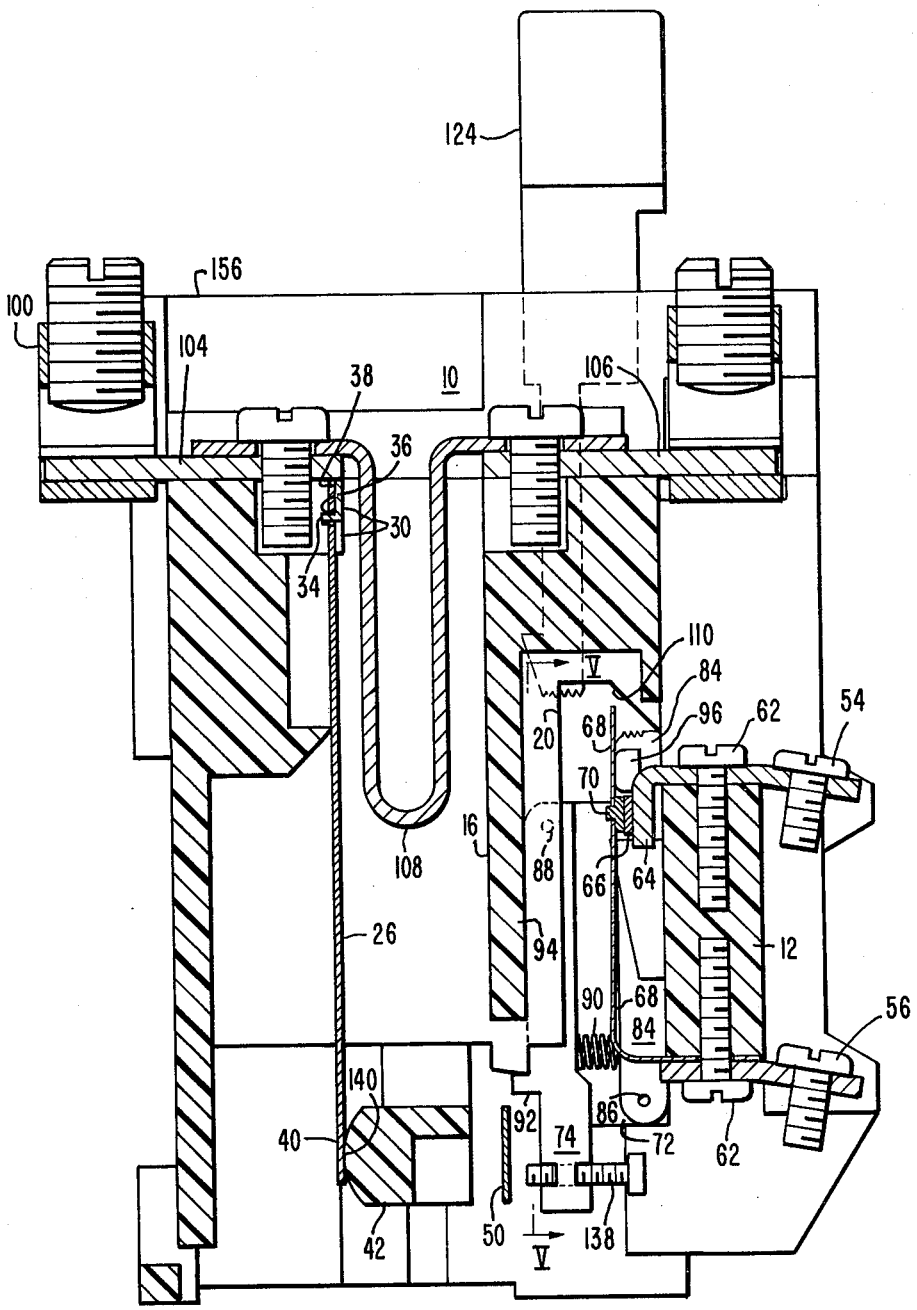
FIG. 3 is a vertical sectional view taken on the line III—III of FIG. 1.

In accordance with this invention, the relay 10 comprises an operating mechanism for opening a circuit through two pairs of terminals 54, 56 and 58, 60 (FIGS. 2, 3, 4) which are connected by suitable leads (not shown) to a coil of an electromagnetic contactor of the type shown in U.S. Pat. No. 3,339,161. As shown in FIG. 3, the pair of terminals 54, 56 is mounted by screws 62 and a down-turned end portion of the terminal 54 includes a contact button 66. The inner end of the terminal 56 comprises a movable contact conductor which is a resilient elongated contact-mounting arm 68 on which a contact button 70 is mounted for engagement with the contact button 66. The contact arm 68 is comprised of a good conducting material, such as copper strip, and is spring-biased to maintain a normally-closed position between the contact 66, 70, thereby providing a closed circuit through an associated electrical device such as a coil of a contactor (not shown). For some other purpose the contact arm 68 may be spring-biased to maintain the contacts 66, 70 in a normally open position.

The operating mechanism also comprises a block or slide 72 and a latch lever 74 which are located within the chamber 20. The slide 72 is slidable between opposite interior walls 76, 78 (FIG. 6) and includes a projection 80 which, in cooperation with a spring 82, biases the slide 72 upwardly in which position the contacts 66, 70 are open.

The operating mechanism also comprises actuating means such as a trip arm 84 which is pivotally mounted on the slide 72 at pivot pin 86 and is generally parallel with the latch lever 74 which in turn is pivotally mounted on a pivot pin 88. The members 74, 84 are mounted on the same side of the slide 72 and a spring 90 is disposed between them to bias said members apart.

Figure 5:
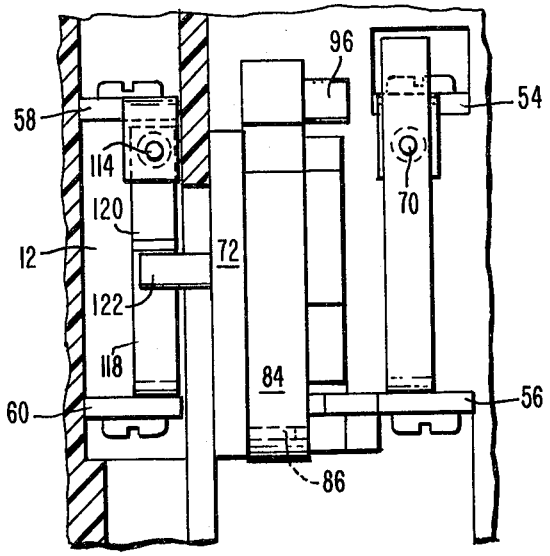
FIG. 5 is a vertical sectional view taken on the line V—V of FIG. 3; p

The latch lever 74 comprises a projection 92 which engages the lower end of a housing partition 94 in the latched position of the lever (FIG. 3). The trip arm 84 comprises a projection 96 (FIGS. 3, 5) for moving the contact arm 68 to the left, thereby opening the contacts 66, 70.

Figure 1:
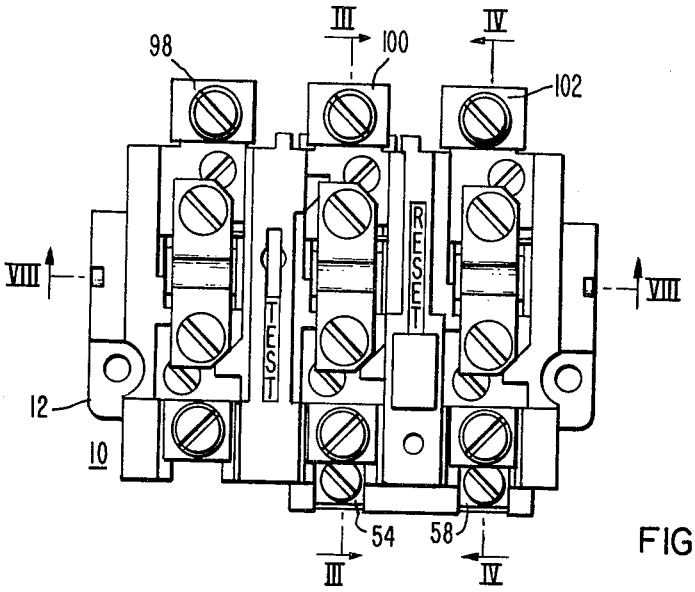
FIG. 1 is a plan view of the device of this invention.

As shown in FIGS. 1 and 3, the housing 12 supports three spaced terminals 98, 100, 102, which as shown for terminal 100, by way of example, comprise terminal conductors 104, 106 and a U-shaped interconnecting heater strap 108. When a normal current passes through the terminals 98, 100, 102, the corresponding bimetal elements 24, 26, 28 remain in the position shown in FIG. 3, whereby the latch lever 74 is in the latched position (FIG. 3). When a overload current occurs, the heater strap 108 is heated sufficiently to cause one or more of the associated bimetal elements 24, 26, 28 to flex to the right to rotate the common crossbar 42 counterclockwise.

During that movement the compensating bimetal 50 moves against the latch lever 74 which rotates counterclockwise to dislodge the projection 92 from the latched position, whereupon the spring 82 raises the assembly of the slide 72 and trip arm 84. As a result, the upper end of the trip arm 74 slides along an inclined (45°) surface 110 of the housing and with the projection 96 moves the contact arm 68 counterclockwise, thereby opening the circuit between the contacts 66, 70.

Figure 4:
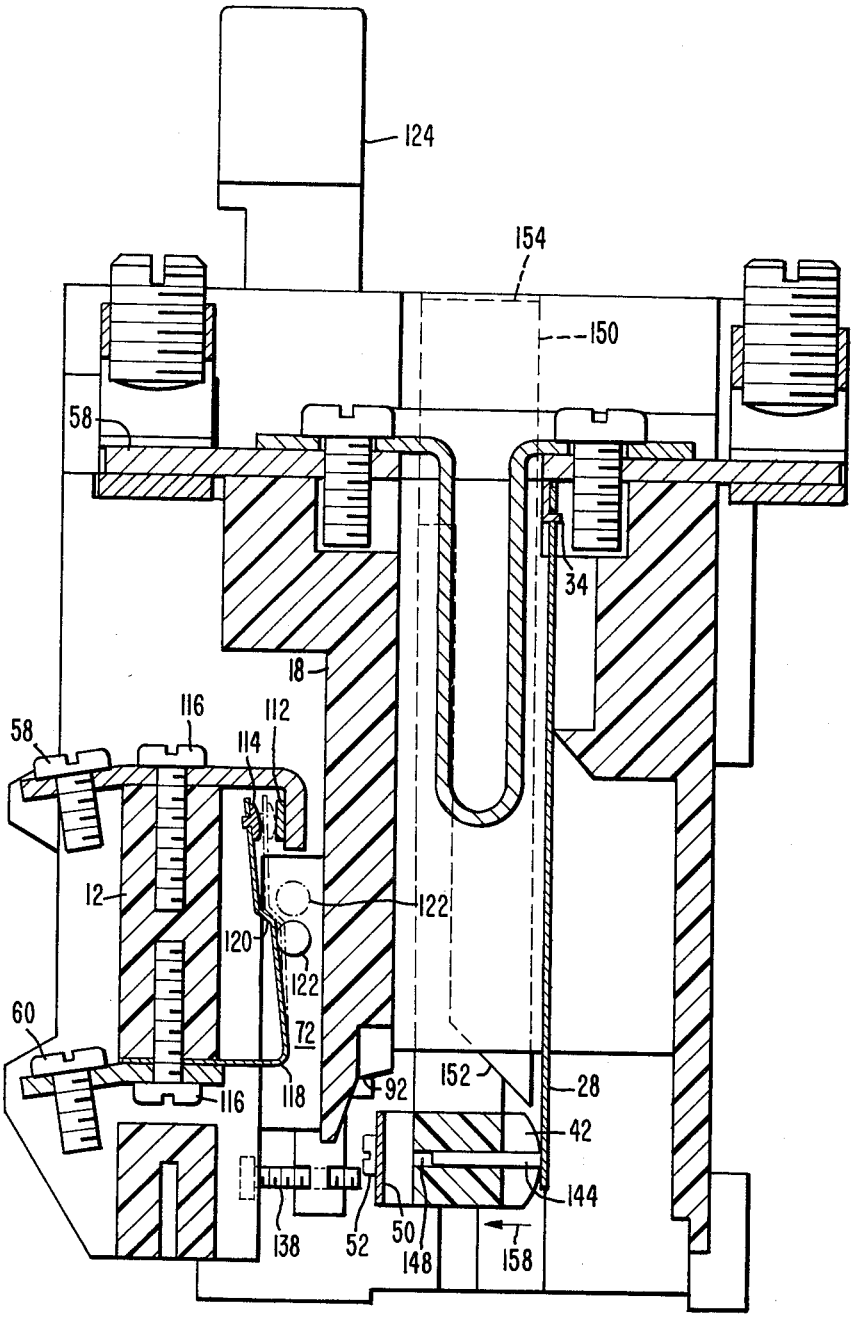
FIG. 4 is a vertical sectional view taken on the line IV—IV of FIG. 1.

Simultaneously, another pair of contacts are acted upon. As shown in FIG. 4, the terminals 58, 60 are secured to the housing 12 by screws 116. The inner end of the terminal 58 has a contact button 112 mounted thereon. The inner end of the terminal 60 is connected to a movable contact structure which includes a resilient elongated contact arm 118 on which a contact button 114 is mounted for engagement with the contact button 112. Like the contact arm 68, the arm 118 is comprised of a metal of good electrical conductivity, such as copper, and is spring-biased toward the contact button 112. In addition, the contact arm 118 has an inclined surface portion 120 which functions with a projection 122 which extends from one side of the slide 72. When the slide is in the lower latch position (FIG. 3) the projection 122 holds the contact arm 118 in the open position (FIG. 4), but when the slide 72 is raised to the unlatched position, the projection 122 moves above the inclined surface portion 120 to enable the contact arm 118 to move through to the closed circuit (broken-line position), thereby closing the circuit through the contacts 112, 114. In this manner, a circuit through the contacts 112, 114 may be used to actuate an alarm or other device indicating the open circuit through the relay 10. On the other hand, the contact arm 118 may have a different function whereby upon reposition of the extension 122 to the left of the arm 118 and changing of the inclined surface portion 120, the contacts 112, 114 may be normally closed.

Figure 7:
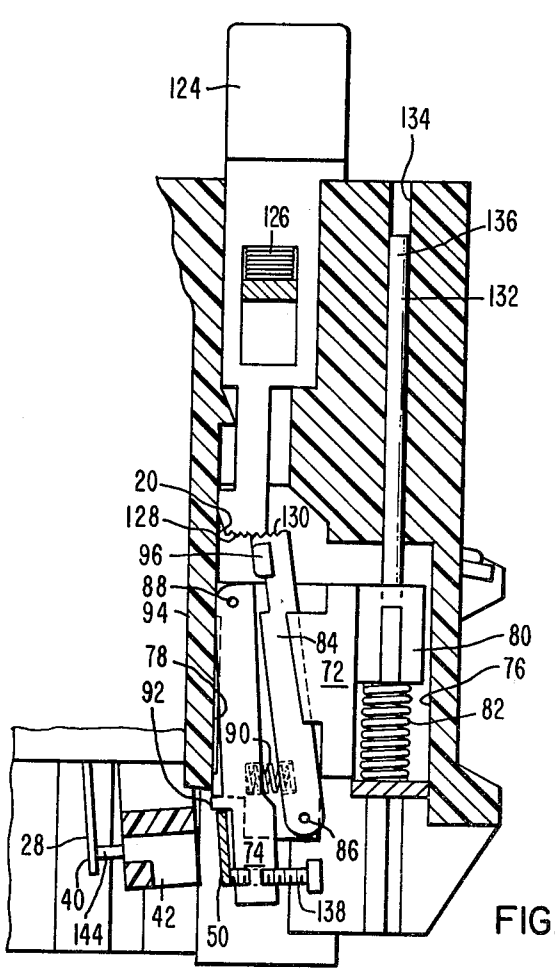
FIGS. 6 and 7 are fragmentary sectional views showing alternate positions of the operating parts.

To reset the relay 10, a reset rod 124 (FIG. 6) is slidably mounted in the upper end of the chamber 20 where it is biased upwardly by a spring 126. The lower end surface 128 has interlocking means, such as serrations, that engage corresponding interlocking or serrated edge 130 on the trip arm 84. As the reset rod 124 is lowered manually, the serrated edge 128 engages the serrated edge 130 and continued lowering of the rod moves the assembly of the slide 72 and the latch arm 74 to a relatch position (FIG. 7). So long as one of the bimetals, such as the bimetal 26, is deflected, the latch arm 74 remains in the unlatched position so that the projection 92 cannot engage the lower end of the housing partition 94, not withstanding the spring 90. Release of the reset arm 124 permits the spring 82 to return the slide 72 and the arm 84 to return the movable contacts 70 and 114 to their normally closed and normally open positions, respectively.

Figure 6:
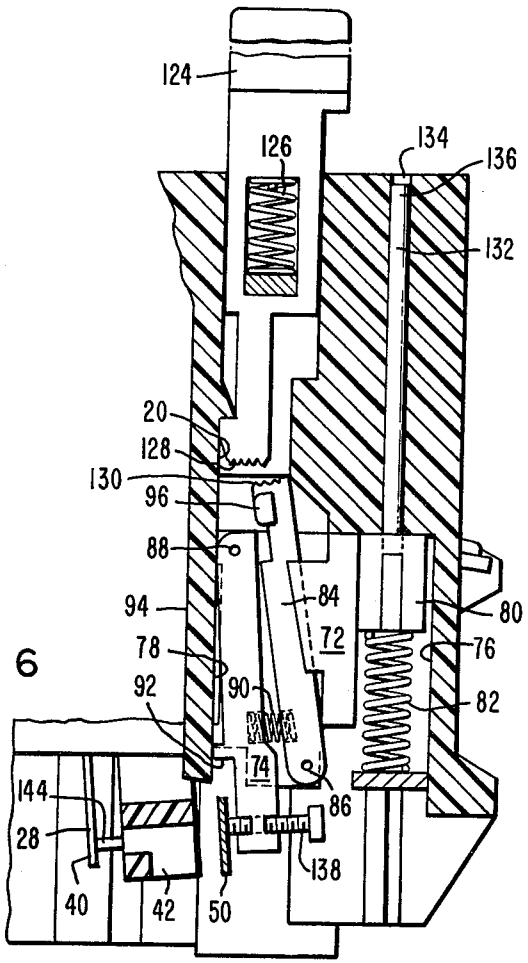

Associated with the reset rod 124 is trip indication means comprising an elongated indicator rod 132 the lower end of which rests upon the upper side of the slide 72 from where it extends upwardly through an aperture 134. The upper end 136 of the rod 132 is evident in the upper end of the aperture 134 when the relay 10 is in trip position (FIG. 6). However, the upper end 136 is retracted from the upper end of the aperture 134 when the relay is in the latched position (FIG. 7).

When the overload condition which causes the deflection of the bimetal element 26 is corrected, the bimetal element returns to the position of FIG. 3. Thereafter, when the reset rod 124 is lowered, the compensating bimetal 50 no longer influences the latch lever 74 and the spring 90 returns the lever to the position where, upon release of the reset rod, the projection 92 is seated under the lower end of the housing partition 94 (FIG. 3), the serrated edges 128, 130 disengage, and the spring 90 deflects the trip arm 84 to the retracted position to allow the circuit to close through the contact buttons 66, 70.

An adjusting screw 138 extends through the lower end of the latch lever 74 to regulate the relative movement between the latch lever and the crossbar 42 through the compensating bimetal 50. Moreover, the crossbar 42 includes a projection 140 for providing a single-point contact with the center bimetal element 26. To provide an identical relationship between the crossbar 42 and the other bimetal elements 24, 28, during assembly, the relay 10 is turned so that the crossbar is disposed above the bimetal elements 24, 26, 28 with the projection 140 in contact with the center bimetal 26. Thereafter, two pins 142, 144 are dropped into holes 146, 148, respectively, which pins come to rest on corresponding bimetal elements and are then cemented in place within the holes, thus locating the crossbar in identical relationship with the three bimetal elements.

The invention also comprises push-to-test means comprising an elongated test rod 150 extending through a slot in the housing between the U-shaped heater straps 108. The lower end of the test rod 150 is beveled at 152, and is proximate to the crossbar 42. When it is desirable to test the operation of the latching means, the upper end 154 of the rod 150, disposed in a surface 156 of the housing, is depressed in order to deflect the crossbar 42 counterclockwise in the direction of the arrow 158, thereby unlatching the latch lever 74.

In conclusion, a more economical thermal overload relay is provided which comprises an improved normally closed control circuit, field-mountable normally open control circuit, push-to-test means, and a trip indicator in a readily visible portion of the housing.

What is claimed is:

1. An electrical control device comprising a housing, one pair of spaced terminals on the housing, one of the terminals comprising a stationary contact within the housing, a movable contact mounted on and extending from the other terminal and being biased in one of the open and closed positions of the stationary contact, the movable contact comprising a resilient elongated contact arm which is spring-biased in one of the open and closed positions, a slide within the housing for moving the movable contact between said positions, latch means on the slide for latching the slide in one of said positions and being spring-biased in the other position, manual reset means for moving the slide to a latched position, at least one pole unit including a bimetal element responsive to current flow to effect heating thereof, and means associated with the latch menas for unlatching the latch means.

2. The device of claim 1 in which there are two pairs of spaced terminals, and a resilient elongated contact support arm being mounted on and extending from one terminal to the other of each pair of terminals.

3. The device of claim 2 in which one of the movable contact is in a normally closed position and the other movable contact is in a normally open position.

4. The device of claim 3 in which actuating means are on the slide for moving said contact support arm between their respective open and closed positions as the slide moves between latched and unlatched positions.

5. The device of claim 4 in which the movable contact comprises a pivotally mounted lever that is biased in one position to effect closing of one movable contact when the latch means is latched, and is movable to a second position to effect opening of the movable contact when the latch means is unlatched.

6. The device of claim 6 in which the slide comprises projection on the slide that is movable into and out of the path of movement of each contact support arm to effect opening and closing of the contacts when the slide moves the between latched and unlatched positions.

* * * * *